US008522995B2

(12) United States Patent
Voss et al.

(10) Patent No.: US 8,522,995 B2
(45) Date of Patent: Sep. 3, 2013

(54) PIERCING FLIPTOP CLOSURE

(75) Inventors: Leslie A. Voss, Jacksonville, FL (US); Catie A. Morley, Jacksonville, FL (US); James Timothy Davis, Jacksonville, FL (US); Gary S. Hall, Jacksonville, FL (US)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 221 days.

(21) Appl. No.: 12/912,830

(22) Filed: Oct. 27, 2010

(65) Prior Publication Data

US 2011/0100991 A1 May 5, 2011

Related U.S. Application Data

(60) Provisional application No. 61/256,973, filed on Oct. 31, 2009.

(51) Int. Cl.
*B65D 17/42* (2006.01)

(52) U.S. Cl.
USPC ..... 220/277; 220/258.4; 220/278; 206/222; 215/250; 222/83.5

(58) Field of Classification Search
USPC ..... 220/277, 258.4, 259.5, 278; 215/250; 206/222; 222/484, 83.5
See application file for complete search history.

(56) References Cited

U.S. PATENT DOCUMENTS

| | | | | |
|---|---|---|---|---|
| 2,144,817 | A * | 1/1939 | Sinclair | 220/278 |
| 3,347,410 | A * | 10/1967 | Schwartzman | 222/80 |
| 3,913,782 | A * | 10/1975 | Cass | 220/260 |
| 4,722,449 | A * | 2/1988 | Dubach | 215/235 |
| 4,869,399 | A * | 9/1989 | Dubach | 222/83 |
| 4,884,705 | A * | 12/1989 | Debetencourt | 215/250 |
| 5,094,361 | A * | 3/1992 | Dubach | 222/81 |
| 5,482,176 | A * | 1/1996 | Maietta et al. | 220/277 |
| 5,543,097 | A * | 8/1996 | Fang | 264/102 |
| 6,056,142 | A * | 5/2000 | Elliott | 220/278 |
| 6,258,078 | B1 * | 7/2001 | Thilly | 604/411 |
| 6,305,576 | B1 * | 10/2001 | Leoncavallo | 222/83.5 |
| 6,609,612 | B2 * | 8/2003 | Vlodek | 206/222 |
| 6,685,055 | B2 * | 2/2004 | Taylor | 222/83 |
| 6,715,646 | B2 * | 4/2004 | Suffa | 222/153.06 |
| 6,959,839 | B2 * | 11/2005 | Roth et al. | 222/83 |
| 7,152,767 | B2 * | 12/2006 | Seelhofer | 222/536 |
| 7,549,558 | B2 * | 6/2009 | Weist | 222/83 |
| 7,900,787 | B2 * | 3/2011 | Oh et al. | 215/6 |
| 2002/0179461 | A1 * | 12/2002 | Mollstam et al. | 206/222 |
| 2003/0071057 | A1 * | 4/2003 | Suffa | 222/83.5 |
| 2003/0209570 | A1 * | 11/2003 | Joshi et al. | 222/420 |
| 2007/0181522 | A1 * | 8/2007 | Davidson | 215/228 |
| 2009/0084814 | A1 | 4/2009 | Wisniewsaki et al. | |
| 2009/0101618 | A1 * | 4/2009 | Seelhofer | 215/237 |

FOREIGN PATENT DOCUMENTS

WO WO 2006/057536 A1 6/2006

* cited by examiner

*Primary Examiner* — Anthony Stashick
*Assistant Examiner* — Christopher McKinley

(57) ABSTRACT

The invention closures that opens sealed containers and close such containers thereafter and method of using the same.

14 Claims, 12 Drawing Sheets

PIERCING FLIPTOP CLOSURE

RELATED APPLICATIONS

This application claims the benefit of provisional application, U.S. Ser. No. 61/256,973 filed on Oct. 31, 2009.

FIELD OF THE INVENTION

This invention relates to closures that opens sealed containers and close such containers thereafter.

BACKGROUND

Liquid products such as foods, cosmetic products, pharmaceutical products and the like are packaged in containers that are sealed to prevent contamination from tampering or environmental factors. Some of these liquids are sterilized prior to their encapsulation in a container and some liquids are sterilized along with their containers after encapsulation of the liquid. In either case, a sealed container is presented to the consumer and the consumer often has difficulty in opening the container. One particular method of encapsulating sterilized liquids in their container is commonly known as Blow-Fill-Seal ("BFS"). In this method liquid products are sterilized and immediately loaded to molded plastic bottles shortly after such containers are molded while the molded plastic is at an elevated temperature. This procedure reduces the cost of producing a sterilized product because the encapsulated liquid product and its packaging do not need to be sterilized after loading. However, BFS produces container that must be opened by cutting through the container material and often consumers have trouble opening such containers. Further in the case of multiple use liquid products, such a pharmaceutical products, the consumer must also have a method of resealing the container from environmental factors and accessing its contents at another time. It would be useful if there were closure that opened sealed containers and thereafter permitted the user to close such containers to protect the contents from environmental factors. This need is met by the following invention.

DETAILED DESCRIPTION OF THE INVENTION

This invention includes a closure for opening and covering a sealed container comprising a pierce plate, a rotatable locking tab, a cap, a pivot, and a container skirt wherein said closure moves between a first closed position, an open position and a second closed position.

- wherein said pierce plate comprises an upper surface, a lower surface, a locking plate portion, a piercing portion, a rim lock portion, and an aperture
  - wherein said piercing portion is juxtaposed to the lower surface comprises a channel that is aligned with said aperture to permit fluid to flow between the channel and the aperture
  - wherein the upper surface of said piercing plate sits on an inclined plane at an angle from the locking plate portion to the rim lock portion wherein said angle is determined by orienting the upper surface along a horizontal plane and angling the rim lock portion above the horizontal plane and the locking plate portion below the horizontal plane
- wherein said rotatable locking tab comprises a cap connection portion and a toe portion
  - wherein said cap connection portion is juxtaposed to cap and moves in response to movement of the cap
  - wherein said toe portion sits below the locking portion of the pierce plate and rotatably contacts to move said locking plate portion and the pierce plate when the cap and the cap connection portion move from the first closed position to the open position
  - wherein said toe portion moves substantially tangential to said locking plate portion of the pierce plate but does not substantially move said pierce plate when said cap moves from the open position to a second closed position.
- wherein said cap comprises an aperture cover
- wherein said container skirt comprises a rim stop and a container neck,
  - wherein when pierce plate moves in response to the movement of said toe portion said rim lock portion engages said rim stop to substantially hold said pierce plate and to actuate the piercing portion and
  - wherein said container neck is adapted to mate with a container
- wherein said pivot is juxtaposed to the lower surface of the pierce plate.

Figure 1:
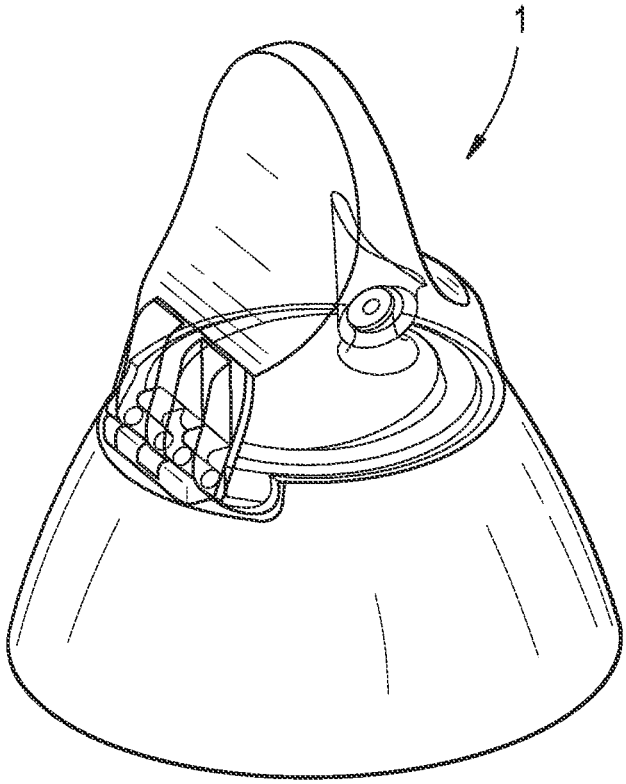
FIG. 1 illustrates a perspective see-though view of a closure of the invention
Figure 2:
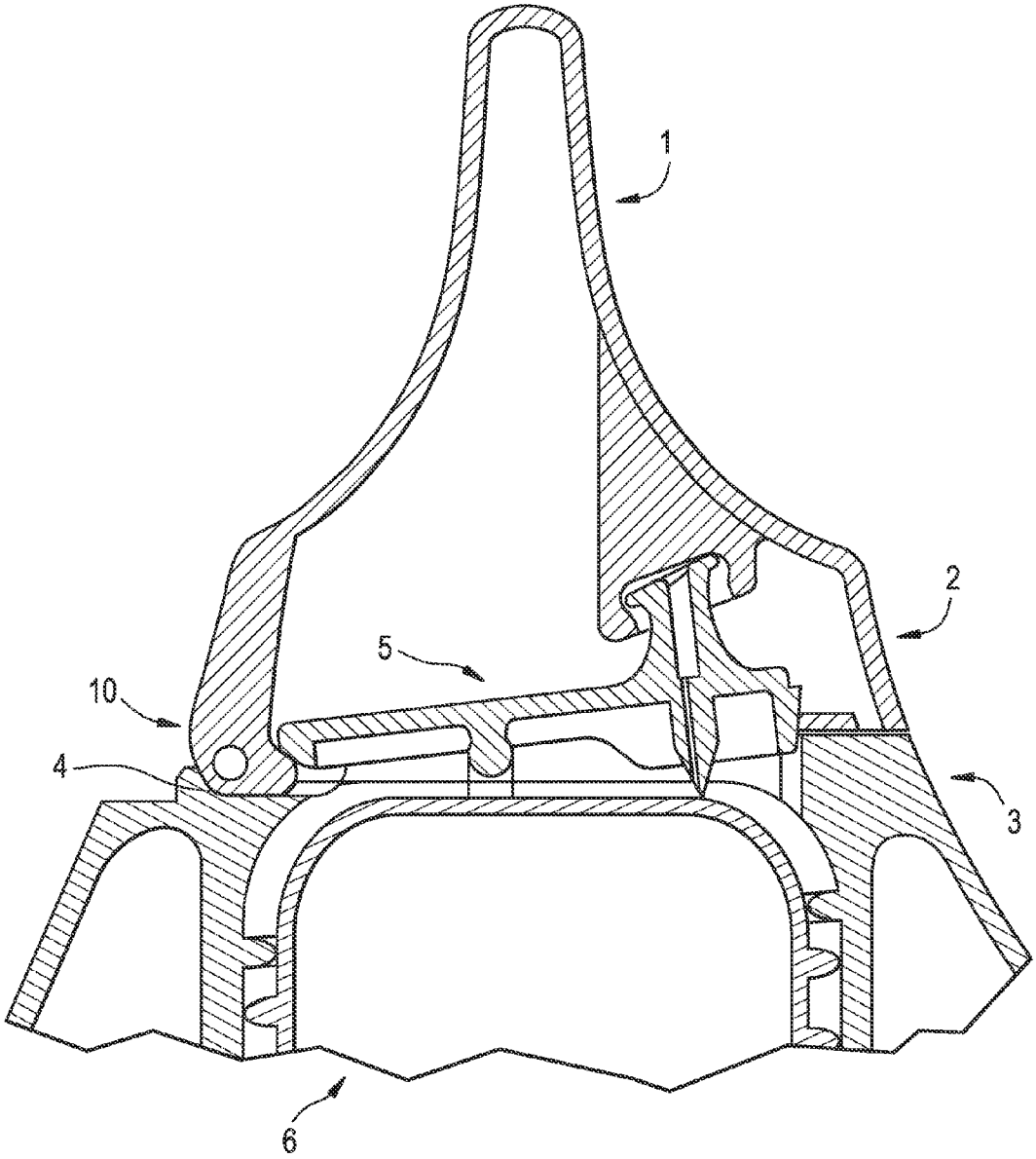
FIG. 2 illustrates a cross sectional view of a closure of the invention and an attached container.
Figure 3:
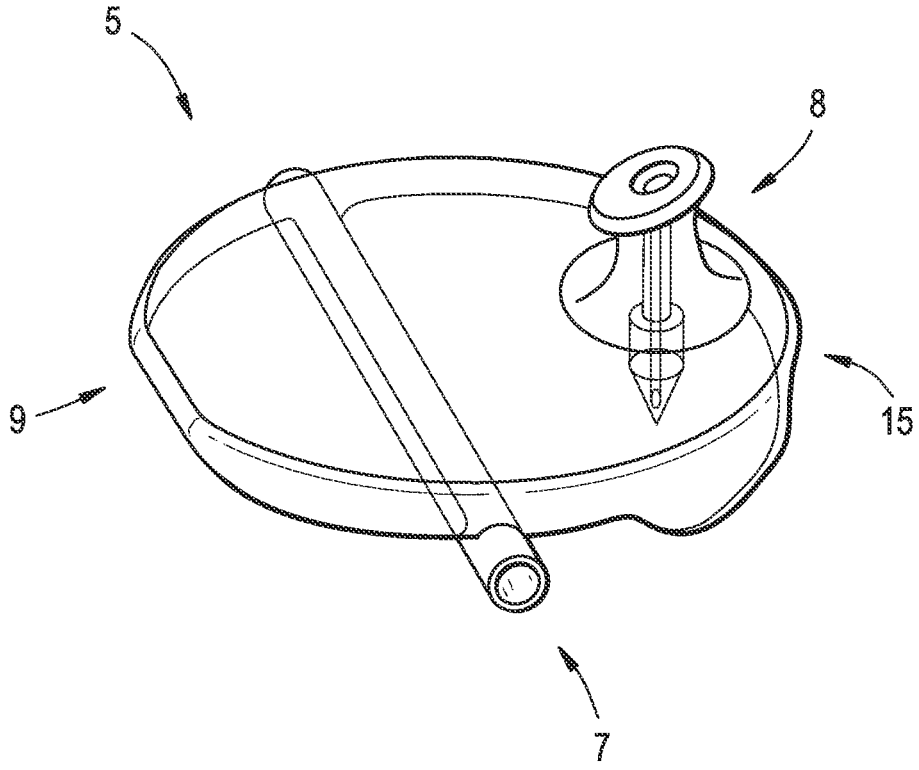
FIG. 3 illustrates a perspective view of a pierce plate
Figure 4:
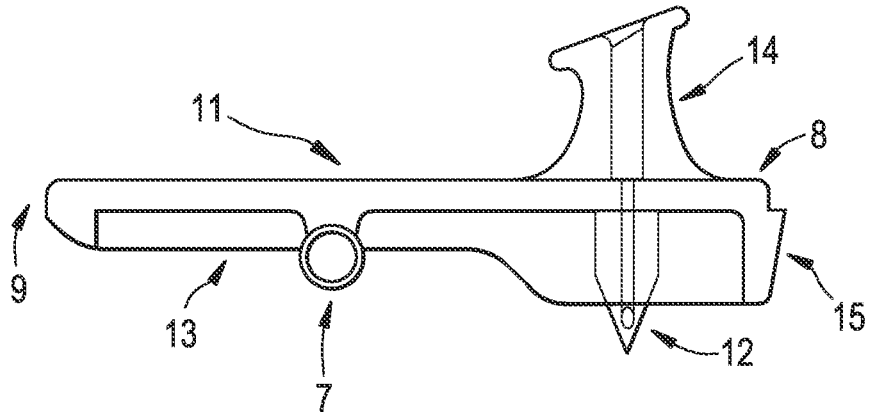
FIG. 4 illustrates a see through side view of a pierce plate

FIG. 1 illustrates a see-through perspective view of a closure 1 of the invention. FIG. 2 illustrates a cross sectional view of closure 1 in the first closed position. Cap 2 is juxtaposed to rotatable locking tab 4 at cap connection 10 Pierce plate 5 is inclined at an angle from the locking plate portion to the rim lock portion. The container skirt 3 surrounds a container 6 and is attached to the container by a threaded connection. However, this mating may be accomplished by a number of methods including snap fits, pressure fits, welding, bonding, quarter turn type fastening, methods and adhesive methods. FIG. 3 is a perspective view of pierce plate 5 of this embodiment. The locking plate portion 9 and the rim lock portion 8 are illustrated. FIG. 4 illustrates a see-through side view of pierce plate 5. The aperture of pierce plate 5 is hidden under spout 14 which has a channel therein that connect to the pierce plate's aperture. Pierce plate 5 has an upper surface 11, a lower surface 13, and a pivot 7 attached to the lower surface 13. The pivot need not be attached to the pierce plate. For example it could sit so that it is engaged with the lower surface of the pierce plate and the container, or it could be attached to the container. In the preferred embodiment of the invention, the pivot is attached to the pierce plate and a point approximately at the midpoint (lengthwise) of the lower surface of the pierce plate.

In addition a piercing portion 12 sits attached to lower surface 13, however in other embodiments piercing portion 12 may be juxtaposed to lower surface 13. Piercing portion 12 contains a channel therethrough that connects to the pierce plate's aperture and spout 14. The channels of spout 14 and piercing portion 12 are aligned to permit liquids to flow through both channels. The rim lock portion 8 of pierce plate 5 has rim lock 15 attached thereto. Rim lock 15 interconnects with rim stop 16 of the container skirt when the closure is in the open position or the second closed position as described herein.

Figure 5:
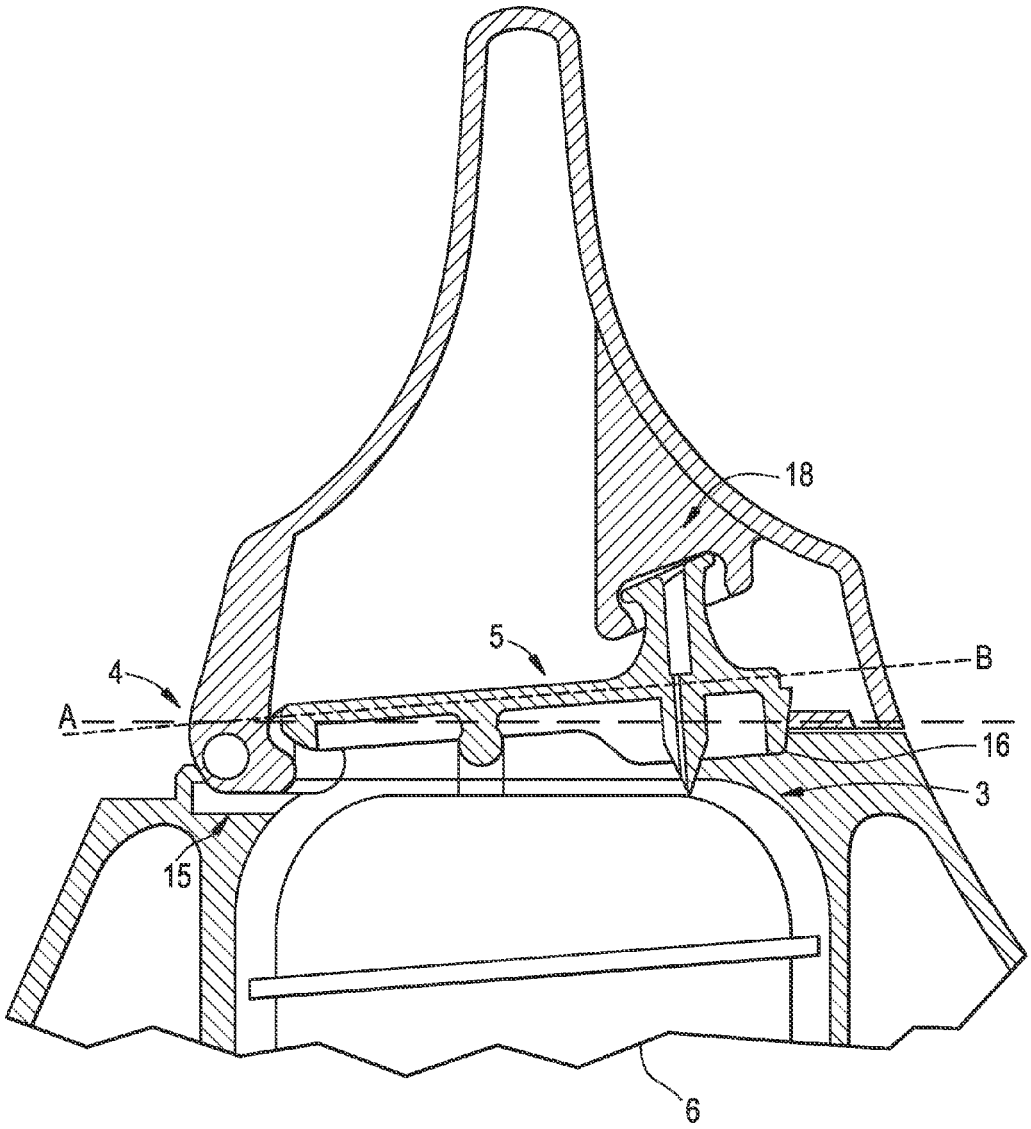
FIG. 5 illustrated a cross sectional view of a closure of the invention and an attached container in the first closed position

FIGS. 5, 6, 7 and 8 illustrate the first closed position, the transition between the first closed and the open positions, the open position, and second closed position, respectively. In FIG. 5 cap 2 is closed and pierce plate 5 is inclined from locking portion 9 to rim locking portion 8. Toe portion 17 sits below locking portion 9 in this position and aperture cover 18 encloses the end of spout 14, covering the open end of the channel therein. Pierce plate is inclined at an angle which is measured from by orienting upper surface 11 of pierce plate 5 in the horizontal plane. The horizontal plane is marked by dashed line A and the incline of upper surface 11 is marked by dashed line B. It is preferred that the angle at which the pierce plate is oriented in the closed position is between about 1 degree and about 30 degrees, preferably about 5 degrees to about 15 degrees, most preferably about 7 degrees.

Figure 6:
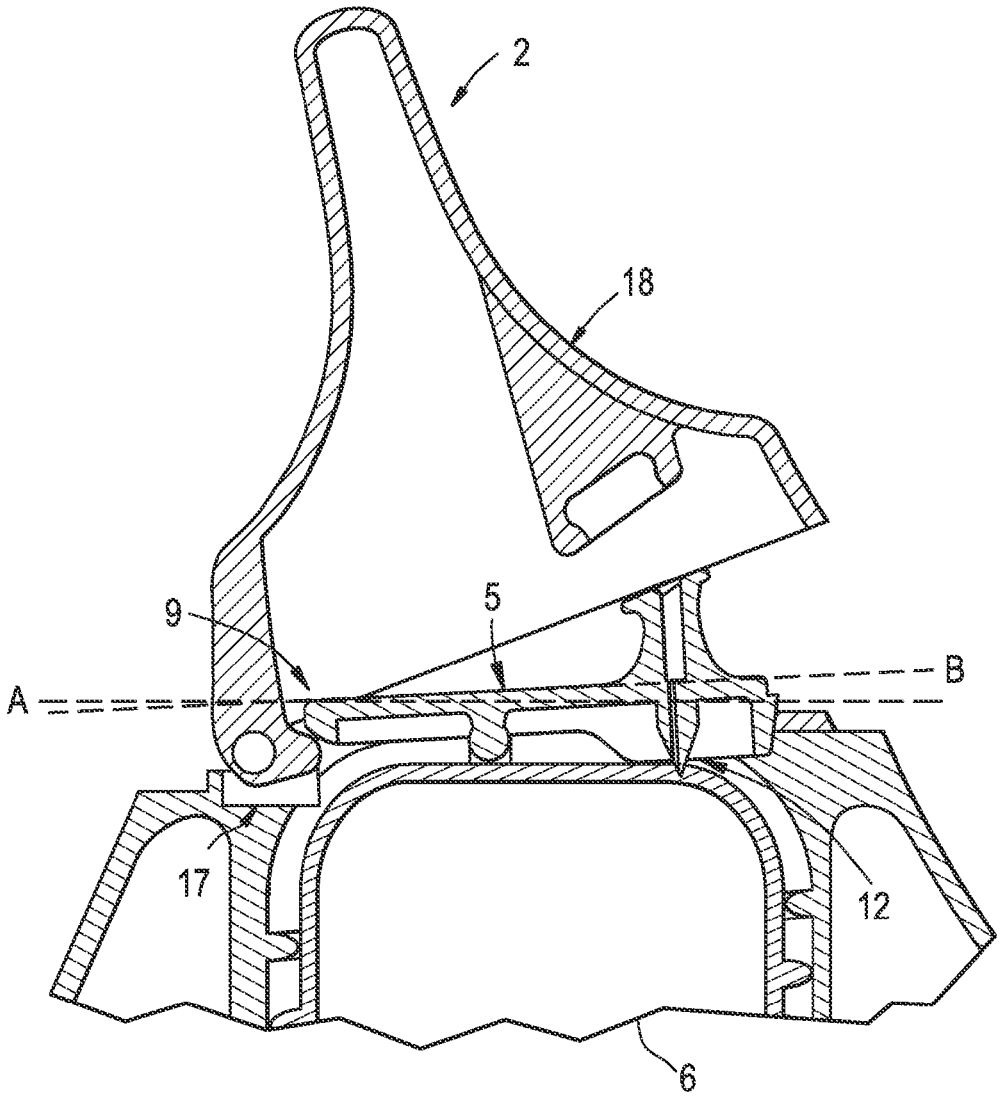
FIG. 6 illustrates a cross sectional view of a closure of the invention and an attached container moving between the first closed position to the open position
Figure 7:
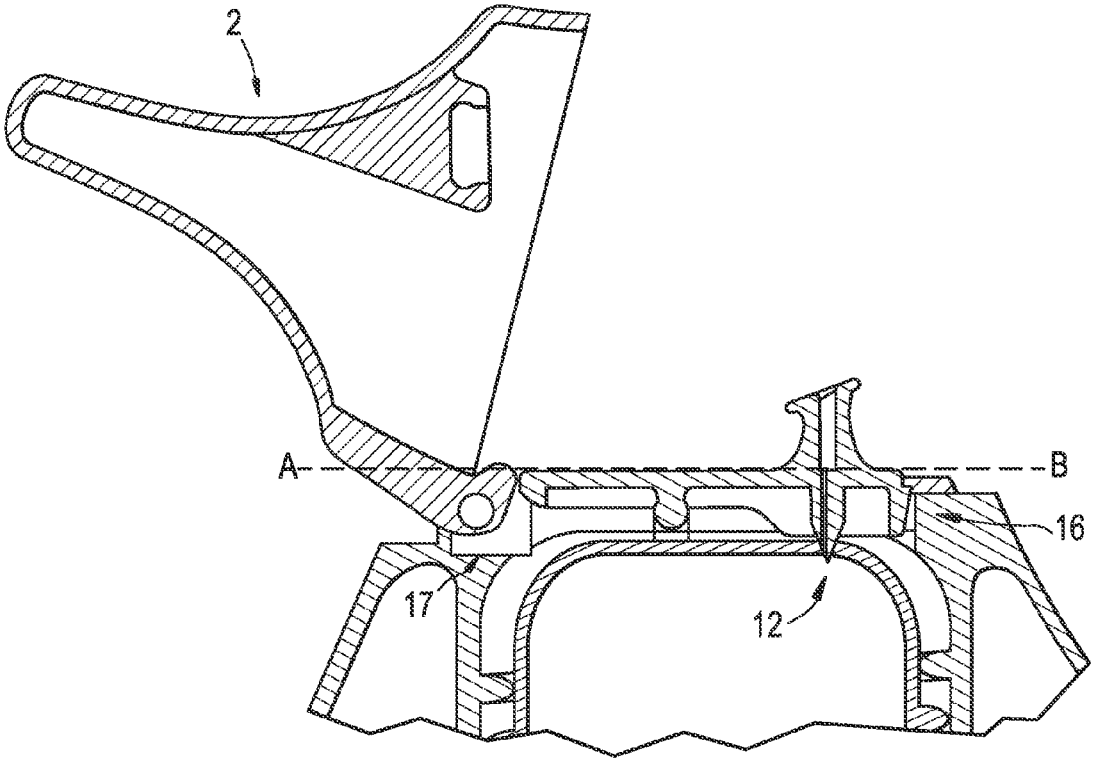
FIG. 7 illustrates a cross sectional view of a closure of the invention and an attached container in the open position.
Figure 8:
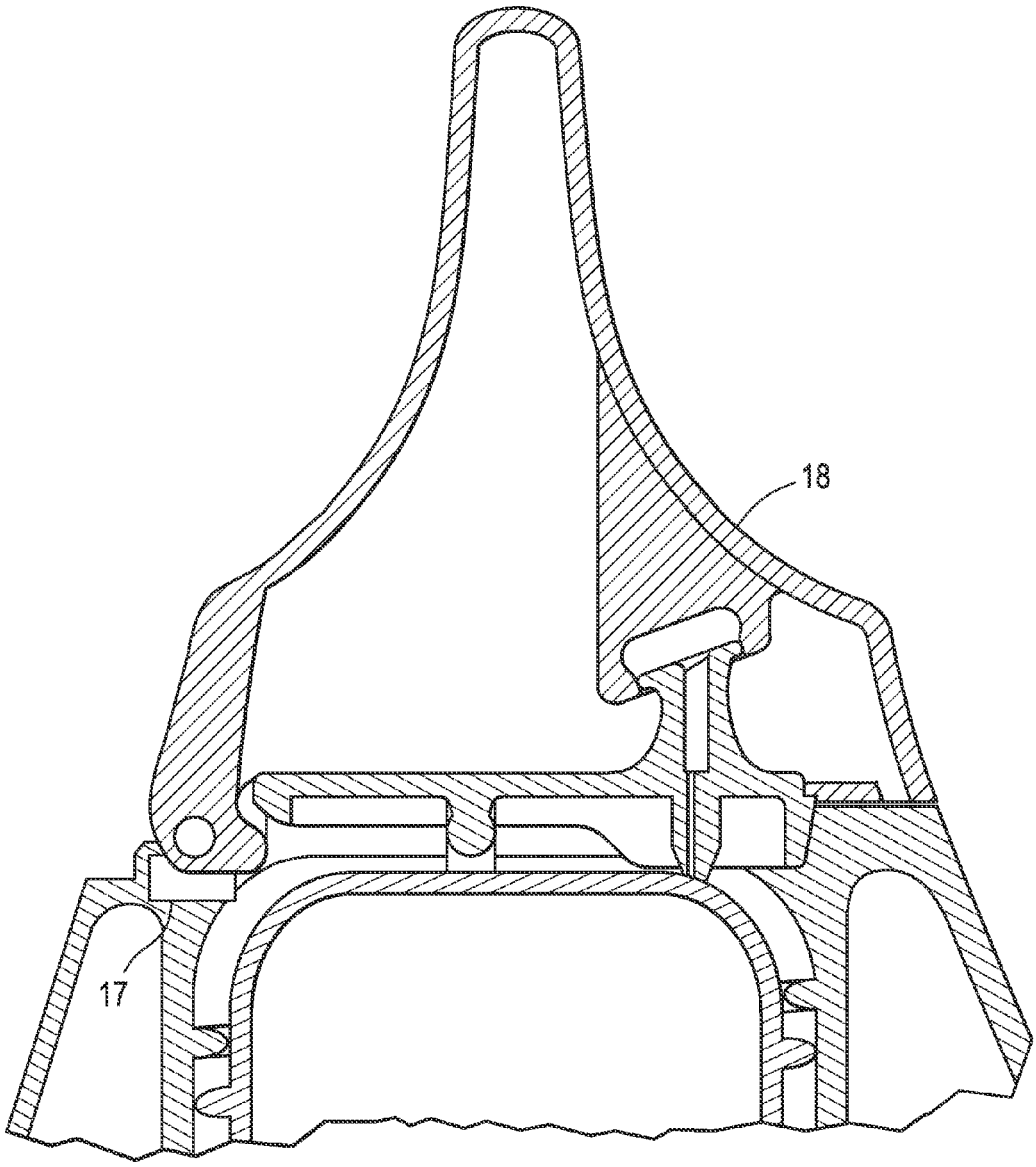
FIG. 8 illustrates a cross sectional view a closure of the invention and an attached container in the second closed position

In FIG. 6 cap 2 moves toward the open position, toe portion 17 pushes locking portion 9 up, aperture cover moves away from the end of spout 14, and lines A and B come closer together. In FIG. 7 rim lock portion 8 and rim lock 15 move to engage rim stop 16 and lines A and B merge in the horizontal plane, as toe portion 17 rotates past locking portion 9. In the preferred embodiment of the invention, the rim lock is attached to the rim lock portion. The rim lock may be a wedge as illustrated in FIG. 4 however, it may be any of a number of either forced fit or interlocking structures. At the same time piercing portion 12 breaks through the surface of container 6. Any liquid products that are in container 6 may now flow through the pierce plate aperture and aligned channels of piercing portion 12 and spout 14. FIG. 8 illustrates the second closed position. Aperture cover 18 moves towards the end of spout 14 to cover it as toe 17 rotates past locking portion 9. When the closure is in the second closed position, the flow of liquid product from the container out of spout 14 is restricted.

Figure 9:
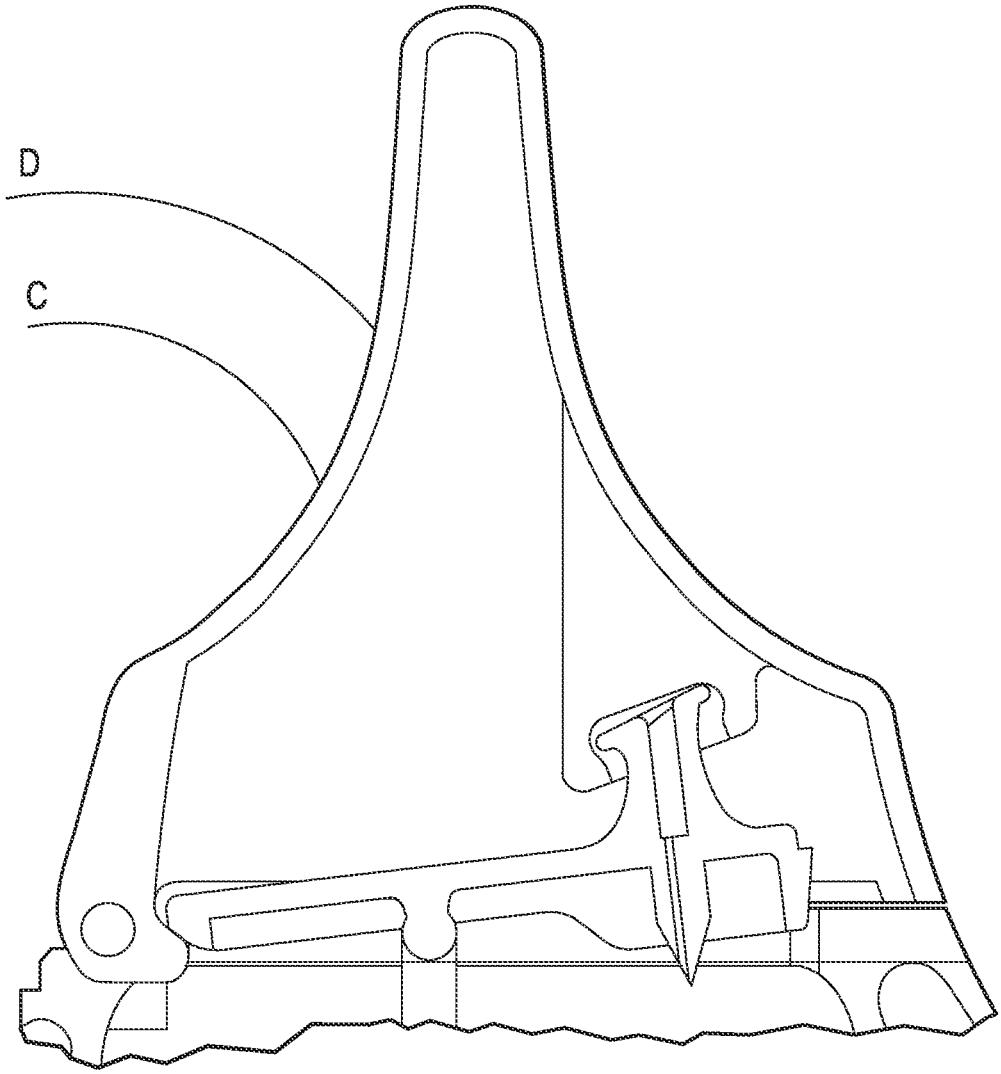
FIG. 9 illustrates details of the aperture cover in the first closed position
Figure 10:
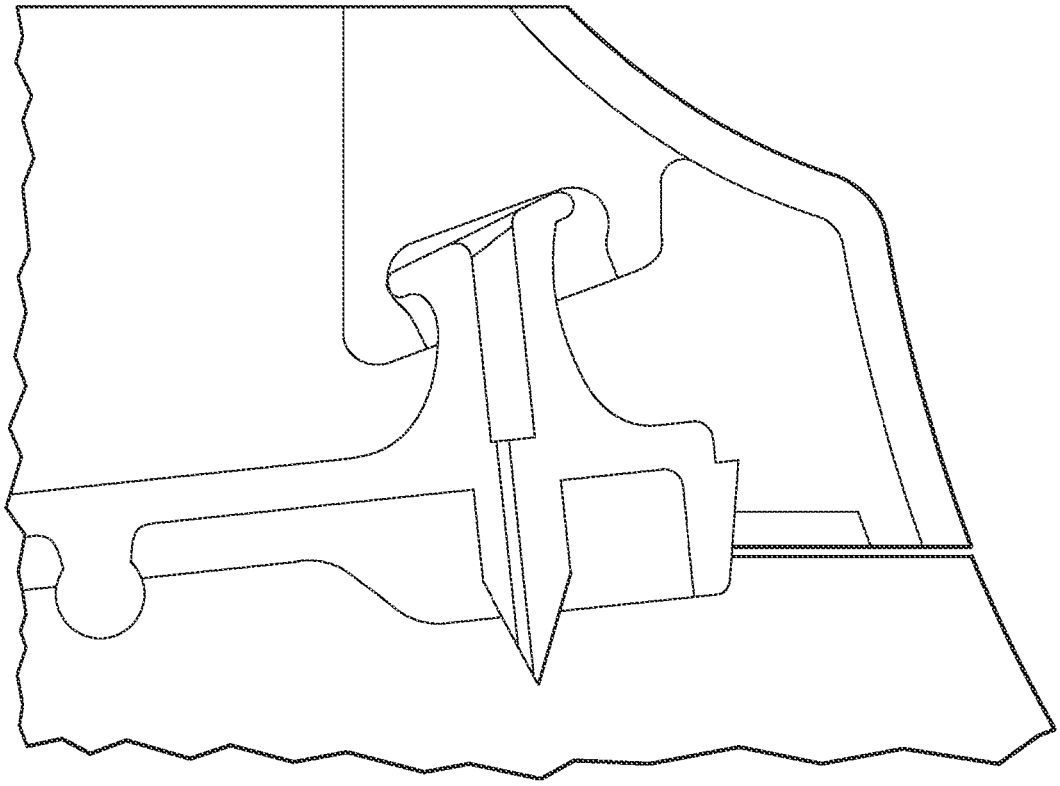
FIG. 10 illustrates an enlarged view of the details of the aperture cover in the first closed position.
Figure 11:
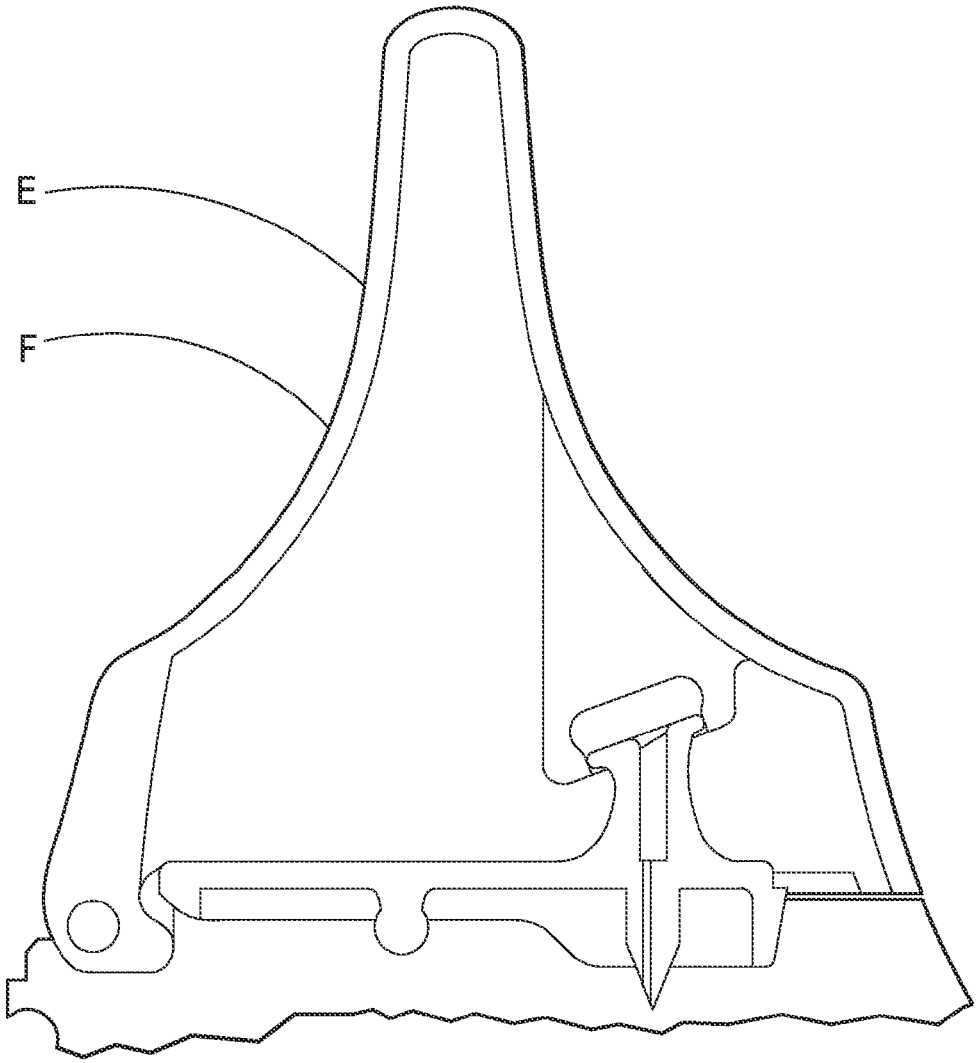
FIG. 11 illustrates details of the aperture cover in the second closed position.
Figure 12:
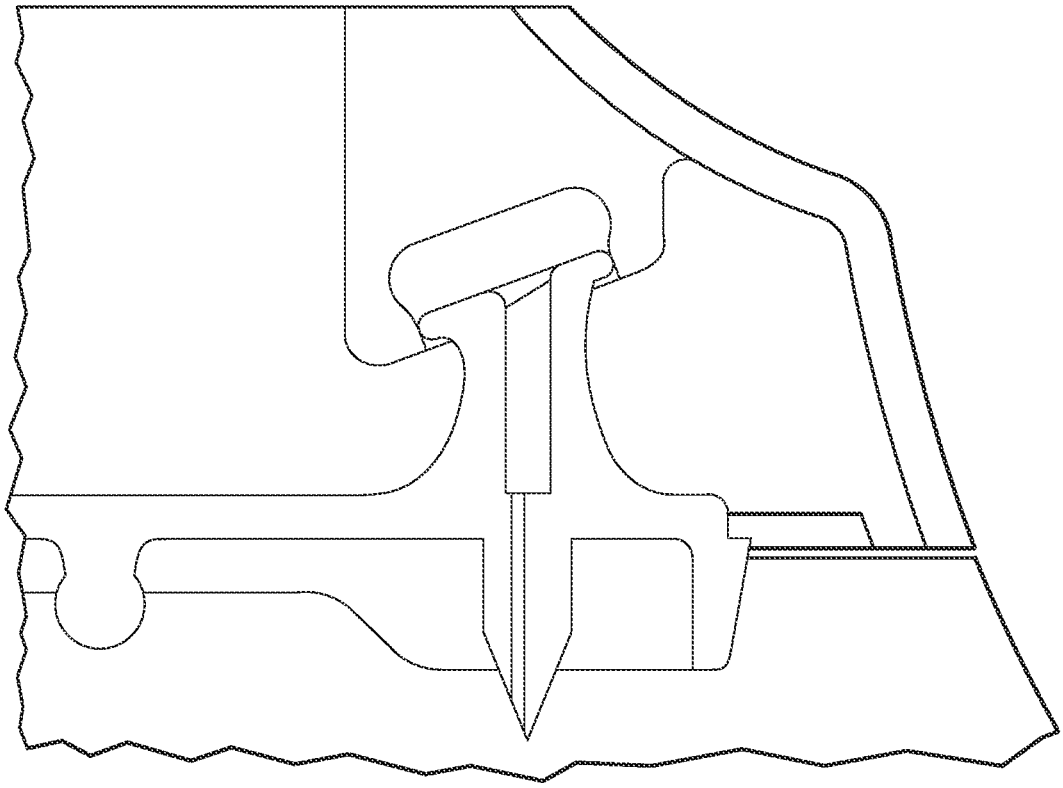
FIG. 12 illustrates an enlarged view of the details of the aperture cove in the second closed position.

In the preferred embodiment substantially no liquid flows from the spout in the second closed position. To accomplish this the geometry of the aperture cover must accommodate the first closed position and the second closed position. FIG. 9 illustrated the interaction of the end of spout 14 with aperture cover 18 in the first closed position. Lines C and D mark the path of the aperture cover and its intersection with the end of spout 14. An enlarged view of this area is illustrated in FIG. 10. FIG. 11 illustrates the interaction of the the end of spout 14 with aperture cover 18 in the second closed position. Lines E and F illustrate the path of the aperture cover and its intersection with the end of spout 14. FIG. 12 illustrates an enlarged view of this area.

The foregoing closures may be made by a variety of plastic materials. It is preferred that the piercing portion is made of any material that is harder than the container, such as polycarbonate. The remainder of the pierce plate may be made of the same material as well. The container skirt and the cap are preferably made of polypropylene. The container may be made of polypropylene as well. However the container is most preferably made of high density polyethylene or preferably low or medium density polyethylene. The cap may be connected to the container skirt by a number of hinging methods including interlocking hinges and living hinges. The pierce plate can be a separate piece as described herein or combined with the container skirt, the cap, or both using living hinges or flexible material methods to achieve the necessary movement. The cap, the rotatable locking tab, and the container skirt may be made separately of different materials. Any of these pieces may be made of unitary construction with or without the container. In the preferred embodiment the rotatable locking tab and the cap are made of unitary construction. Containers which are used with the closures of this invention may be of unitary construction with one or more parts of the closure. For example, the container skirt may be made of unitary construction with the container. Any or all of the components of the closure may be made by injection molding (two material injection molding, overmolding, sandwich molding or insert molding). The container is preferably made by BFS, but may be made of other processes that seal the bottle prior to shipment to the consumer. Machines to perform these task including but not limited to those manufactured by Arburg Gmbh, Ferromatik, Elektra, Engel, Rommelag, and others. Other combinations of materials and construction methods are know to those of skill in the art of molding plastic materials and although such materials and methods are not specifically mentioned herein they are considered to be included in this invention, The foregoing embodiments are only meant to illustrate the invention and not limit it. Those knowledgeable in closures as well as other specialties may find other methods of practicing the invention. However, those methods are deemed to be within the scope of this invention.

What is claimed is:

1. A closure for opening and covering a sealed container comprising a pierce plate, a rotatable locking tab, a cap, a pivot, and a container skirt wherein said closure moves between a first closed position, an open position and a second closed position;

wherein said pierce plate comprises an upper surface, a lower surface, a locking plate portion, a piercing portion, a rim lock portion, and an aperture wherein said piercing portion is juxtaposed to the lower surface, and comprises a channel that is aligned with said aperture to permit fluid to flow between the channel and the aperture;

wherein the upper surface of said piercing plate sits on an inclined plane at an angle from the locking plate portion to the rim lock portion wherein said angle is determined by orienting the upper surface along a horizontal plane and angling the rim lock portion above the horizontal plane and the locking plate portion below the horizontal plane;

wherein said rotatable locking tab comprises a cap connection portion and a toe portion, wherein said cap connection portion is juxtaposed to said cap and moves in response to movement of the cap, wherein said toe portion sits below the locking portion of the pierce plate and rotatably contacts to move said locking plate portion and the pierce plate when the cap and the cap connection portion move from the first closed position to the open position, wherein said toe portion moves substantially tangential to said locking plate portion of the pierce plate but does not substantially move said pierce plate when said cap moves from the open position to a second closed position wherein said cap comprises an aperture cover;

wherein said container skirt comprises a rim stop and a container neck, wherein when pierce plate moves in response to the movement of said toe portion said rim lock portion engages said rim stop to substantially hold said pierce plate and to actuate the piercing portion; and wherein said container neck is adapted to mate with a container;

wherein said pivot is juxtaposed to the lower surface of the pierce plate.

2. The closure of claim 1 wherein said pierce plate further comprises a spout comprising a channel that extends through said spout and is attached to said aperture.

3. The closure of claim 1 wherein said rotatable locking tab is attached to said cap.

4. The closure of claim 1 wherein said pierce plate comprises a rim lock.

5. The closure of claim 4 wherein said rim lock is a wedge.

6. The closure of claim 1 wherein the pierce plate comprises polycarbonate.

7. The closure of claim 1 wherein the container skirt and the pierce plate are of unitary construction.

8. The closure of claim 1 wherein said pierce plate further comprises a pivot.

9. The closure of claim 1 wherein the cap, the skirt, the pierce plate, and the rotatable locking tab are of unitary construction.

10. The closure of claim 1 wherein the cap, the skirt and the rotatable locking tab are of unitary construction.

11. The closure of claim 1 further comprising a blow fill seal container, comprising a liquid product encases therein.

12. The closure of claim 9 wherein the pivot is juxtaposed to the lower surface of the pivot plate and the container.

13. The closure of claim 9 wherein the container is mated to the container skirt by a snap fit connection.

14. The closure of claim 9 wherein the container is mated to the container skirt by a threaded connection.

* * * * *